US005322470A

United States Patent [19]

Vartiainen et al.

[11] Patent Number: 5,322,470

[45] Date of Patent: Jun. 21, 1994

[54] VENTILATION APPARATUS

[75] Inventors: Seppo Vartiainen; Kaarlo Korhonen, both of Mikkeli, Finland

[73] Assignee: Jeven Oy, Mikkeli, Finland

[21] Appl. No.: 920,490

[22] PCT Filed: Mar. 28, 1991

[86] PCT No.: PCT/FI91/00088

§ 371 Date: Aug. 13, 1992

§ 102(e) Date: Aug. 13, 1992

[87] PCT Pub. No.: WO91/15311

PCT Pub. Date: Oct. 17, 1991

[30] Foreign Application Priority Data

Mar. 30, 1990 [FI] Finland ..... 901634

[51] Int. Cl.[5] ..... F24C 15/20; B08B 15/00

[52] U.S. Cl. ..... 454/49; 55/337; 55/440; 126/299 R; 454/339; 454/345

[58] Field of Search ..... 55/337, 440; 126/299 R, 126/299 D; 454/49, 339, 345

[56] References Cited

U.S. PATENT DOCUMENTS

| | | | |
|---|---|---|---|
| 3,393,497 | 7/1968 | Donnelly | 126/299 D X |
| 3,508,383 | 4/1970 | Humbert, Jr. et al. | 55/337 |
| 3,800,689 | 6/1982 | Brown . | |
| 4,354,863 | 10/1982 | Oleszak | 126/299 D X |
| 4,504,292 | 3/1985 | Vöhringer | 55/337 X |

FOREIGN PATENT DOCUMENTS

| | | | |
|---|---|---|---|
| 0054285 | 6/1982 | European Pat. Off. . | |
| 90/14875 | 12/1990 | PCT Int'l Appl. . | |
| 1480904 | 5/1989 | U.S.S.R. | 454/49 |

*Primary Examiner*—Harold Joyce

*Attorney, Agent, or Firm*—Merchant, Gould, Smith, Edell, Welter & Schmidt

[57] ABSTRACT

A ventilation apparatus, which is installed in the ceiling of a room, particularly a kitchen, laundry or the like. The ventilation apparatus (1) comprises a wall element (3) directed downwardly from the ceiling, which wall element is formed of a number of elongated parts (4) provided with vertical chambers (5). The shells (6) of the parts (4) are provided with inlet apertures (7), through which apertures and chambers the exhaust air is conducted out of the room.

11 Claims, 3 Drawing Sheets

VENTILATION APPARATUS

The present invention relates to the ventilation apparatus.

In the prior art there are known ventilation arrangements which are installed in the ceiling of the room, and where the ventilation is realized by using air exhaustion means arranged inside a hood. In connection with the ventilation arrangement, there is installed, generally at an oblique angle, filtering cells, particularly degreasing cells. The purpose of the filtering is to separate contaminations from the exhaust air and to prevent harmful and inflammable materials in particular from entering the ventilation system. Such ventilation arrangements are introduced for instance in the publications DE-A 3,309,208 and U.S. Pat. No. 3,800,689.

The problem with the existing arrangements is that they are applicable only locally. Normally the hood, for example in a kitchen, is installed above the stove, and its purpose is exactly to collect the vapours and fumes created by cooking, and to remove these from the kitchen.

Another drawback with the known devices is that the employed degreasing cells are difficult to keep clean.

in the prior art there are also known so-called false ceiling arrangements, which advantageously cover the whole kitchen or the corresponding ceiling. The input air is conducted to the space from the peripheral areas thereof. Such ventilation arrangements are introduced for instance in the publications DE-A 2,718,611 and U.S. Pat. No. 4,354,863.

A drawback with these arrangements is that the rising air streams containing impurities can proceed unobstructed along the ceiling surface, which consequently increases the exhaust air currents.

Another drawback with these known arrangements is that from the essentially horizontal filter elements, impurities such as water, grease etc. drop on the floor and on the equipment arranged in the room, for instance on stoves.

Yet another drawback is the feeding of input air to the space in question. It is difficult to be arranged effectively.

Another drawback is the fact that noise and sounds in general can freely proceed in the described false ceiling arrangements. Hence, from the point of view of acoustics, the false ceiling arrangements are unsatisfactory.

The object of the present invention is to eliminate the above described drawbacks. A particular object of the invention is to realize a ventilation apparatus for demanding room spaces, which apparatus is flexible in installation and easy to maintain.

The ventilation apparatus of the invention is characterized by the novel features enlisted in the appended patent claim 1.

The ventilation apparatus of the invention comprises at least one wall element directed essentially downwardly from the ceiling, which wall element is composed of a number of elongate parts provided with vertical chambers, the shell of these parts containing inlet apertures, through which apertures and chambers the exhaust air is conducted out of the space in question.

In a preferred embodiment of the apparatus, the inlet apertures are arranged on both sides of the wall element.

In another preferred embodiment of the invention, the wall element is detachably secured to the ceiling.

In another preferred embodiment of the invention, the wall element is formed of at least one module.

In another preferred embodiment of the invention, in conjunction with the wall element, there is arranged a filter.

In another preferred embodiment of the invention, each module includes a top plate, whereby the module can be secured to the ceiling, to corresponding fastening rails in connection with the ventilation duct network.

In another preferred embodiment of the invention, in between the ventilation duct network and the module, there is provided a filter supported against the fastening rails, at the bottom edge whereof there is arranged another set of rails to which the module is secured.

In another preferred embodiment of the invention, each wall element is formed as a filter comprising a cylindrical chamber, the inlet apertures whereof are shaped as at least roughly vertical slots in the top part of the chamber, and provided with guides for setting the incoming exhaust air current into turbulent motion in the chamber, in order to clean the air mainly by using centrifugal force.

In another preferred embodiment of the invention, the slots are wider at the bottom than at the top.

In another preferred embodiment of the invention, the slots are arranged around the chamber at the same height and at even intervals.

In another preferred embodiment of the invention, the length of the slots is less than half, and advantageously one third of the height of the chamber.

In another preferred embodiment of the invention, the guide incorporates a part of the shell which is bent from the shell towards the chamber.

In yet another preferred embodiment of the invention, the bottom part of the chamber includes a detachable bottom element.

An advantage of the invention is that it combines both general and local ventilation in an effective fashion.

Another advantage of the invention is that it is flexible in structure. By means of the wall elements, one or several sections in the ceiling of a particular room can be marked off in order to arrange the ventilation in the most advantageous fashion.

Another advantage of the invention is that by means of the ventilation apparatus, the air streams proceeding near the ceiling surface are stopped, and their progress to the other side of the wall element is prevent.

yet another advantage of the invention is that the installation of the filters is simplified, or alternatively the wall element itself can be formed as a filtering unit, where each elongate part of the wall is formed as a filter. The separation rate of this kind of a filter is sufficiently high to prevent the contamination of the ventilation duct network and the blowing devices. The pressure loss in the filtering unit is not essentially changed during operation. Moreover, the said filtering unit is easy to maintain and fireproof, and it lengthens remarkably the maintenance intervals and working age of any auxiliary or fine filtering equipment possible used in connection thereto.

Yet another advantage of the invention is that it is easily connectable to a ventilation system.

Yet another advantage of the invention is that in conjunction to the wall element, there can be employed auxiliary filters which are easily replaceable.

Another further advantage of the invention is that it is acoustically advantageous. The creation and transmission of extra noises is essentially limited in the assembly of the invention by means of its design, location and modular structure.

Yet another advantage of the invention is that the ventilation apparatus is generally speaking easy to maintain and install owing to its simple basic structure.

The invention is explained in more detail below, with reference to the appended drawings where FIG. 1 is a front-view illustration of a ventilation apparatus of the invention, seen in partial section;

Figure 1:
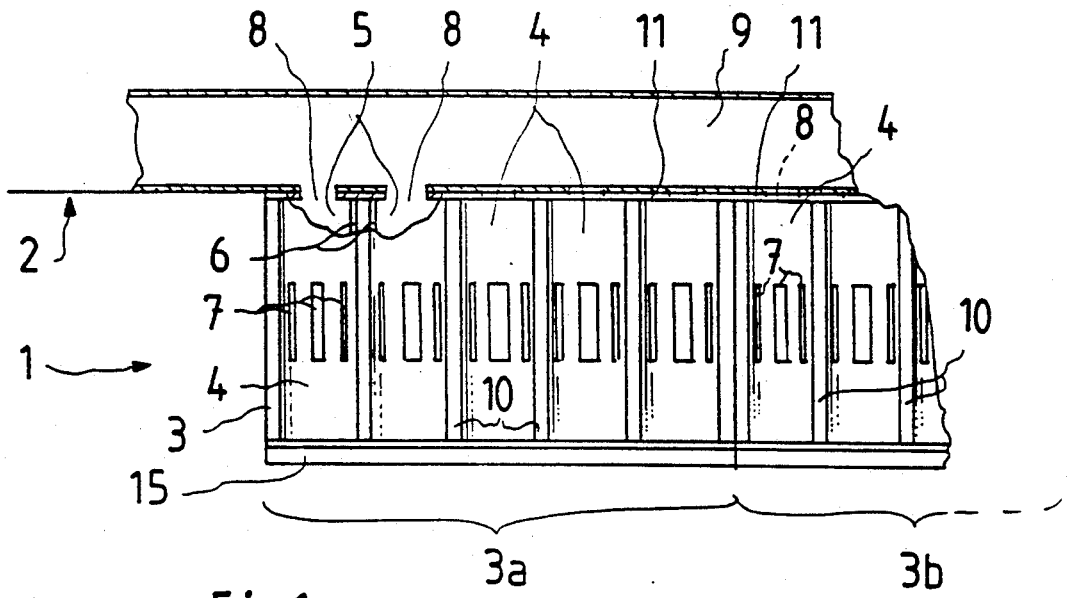

FIG. 1 shows the ventilation apparatus of the invention, installed for instance in the ceiling of an institutional kitchen. The ventilation apparatus 1 comprises a wall element 3, which is direct essentially downwardly from the ceiling 2. In this case the wall element 3 is formed of two identical wall modules 3*a* and 3*b*, composed of a number of elongate parts 4. Each part 4 has a chamber 5 and a surrounding shell 6. The shell 6 is provided with inlet apertures 7, which connect the chamber 5 to the room space. The apertures 7 of each elongate part 4 are arranged on both sides A, B (cf. FIG. 2) of the wall element 3. Respectively, each part 4 is provided with an outlet aperture 8, which connects the chamber 5 to the ventilation duct network 9. In each module 3*a*, 3*b*, the chambers 5 are closed at the bottom by means of a bottom part 15.

In this case each of the wall modules 3*a*, 3*b* include five elongate parts 4. These parts are arranged vertically adjacently, or separated by intermediate plates 10 placed in between them. At the top, the elongate parts 4 of the module 3*a*, 3*b* are connected to each other by means of a top plate 11. The outlet apertures 8 are suitably arranged in the top plate 11. The long sides of the top plate 11 form the shoulders 12. The fastening rails 13 are arranged in the ceiling structure, in the vicinity of the ventilation duct network 9, or directly in the ventilation duct network 9, at a suitable distance from each other, so that by means of the shoulders 12 the wall module 3*a*, 3*b* can be detachably secured in connection to the ventilation duct network.

Figure 3:
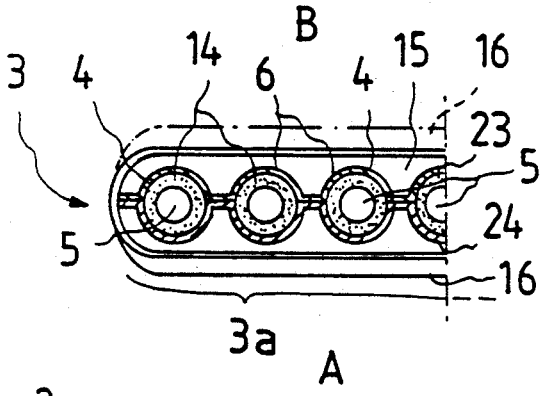
FIG. 3 illustrates the ventilation apparatus of FIG. 2 in a lengthwise section along the line C—C.

In conjunction to the ventilation apparatus of the invention, there is also arranged a filter. The said filter can be located inside the chamber 5 as a socket-like element 14, as is seen in FIG. 3. The filter elements 14 are formed of some suitable filtering materials known as such in the prior art. When required, they can most advantageously be replaced or removed for cleaning. The bottom part 15 of each wall module 3*a*, 3*b* is detachable in order to provide for the maintenance of the filter elements 14.

The edges of the bottom part 15 of the wall modules 3*a*, 3*b*, which are parallel to the lengthwise direction of the module, can be provided with protrusions 16. These protrusions 16 are either stationary or detachable with respect to the bottom part 15.

Figure 4:
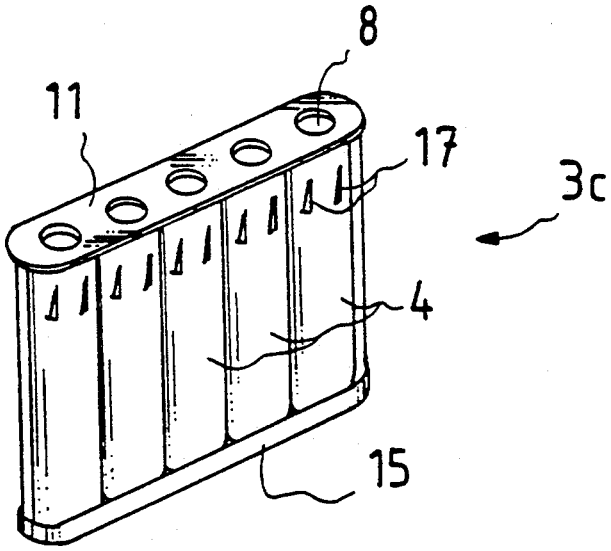
FIG. 4 is an illustration of a wall module of a preferred embodiment of the ventilation apparatus of the invention.
Figure 8:
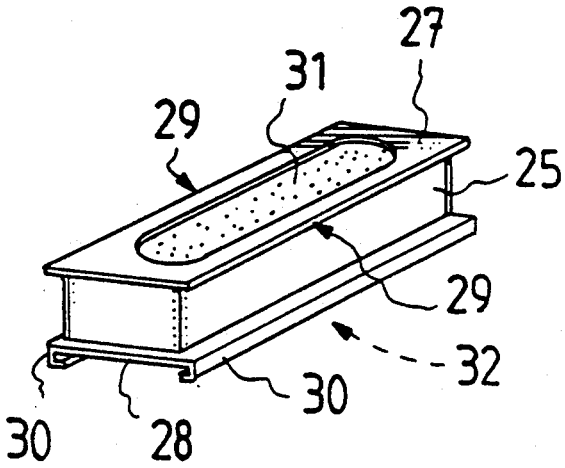
FIG. 8 illustrates an auxiliary filter.

The ventilation apparatus 1 of the invention can also be realized by employing wall modules 3*c* shown in FIG. 4. In this case both the elongate parts 4 and the chambers 5 are cylindrical, and the inlet apertures are formed as slots 17, roughly parallel to the central axis of the chamber. These inlet apertures, or slots 17, are advantageously arranged in the top part of the chamber 5, around the chamber, at the same height and at even intervals. The length of the slots 17 is one third of the height of the chamber. In addition to this, the slots 17 are provided with guides 18, as is apparent from FIGS. 5 and 6.

When realized in this fashion, each of the elongate parts 4 of the wall element is formed as a filter, where the exhaust air current is set to a turbulent motion in the chamber 5 in order to clean the air mainly by using centrifugal force.

Figure 2:
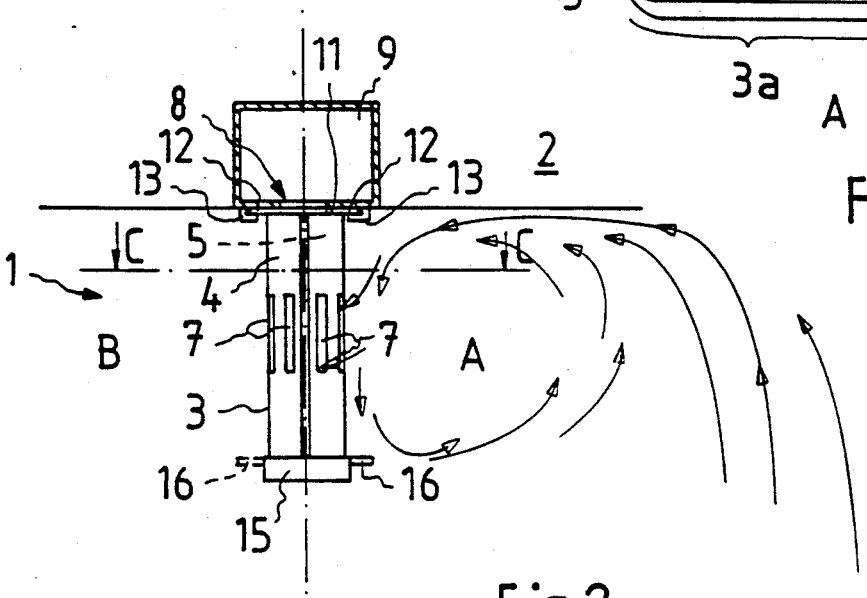
FIG. 2 is a side-view illustration of the apparatus of FIG. 1, seen in partial transversal section.

In other aspects of it structure, the wall module 3*c* corresponds to the wall modules 3*a*, 3*b* described in connection with FIGS. 1, 2 and 3, and consequently like reference numbers apply to like parts.

Figure 5:
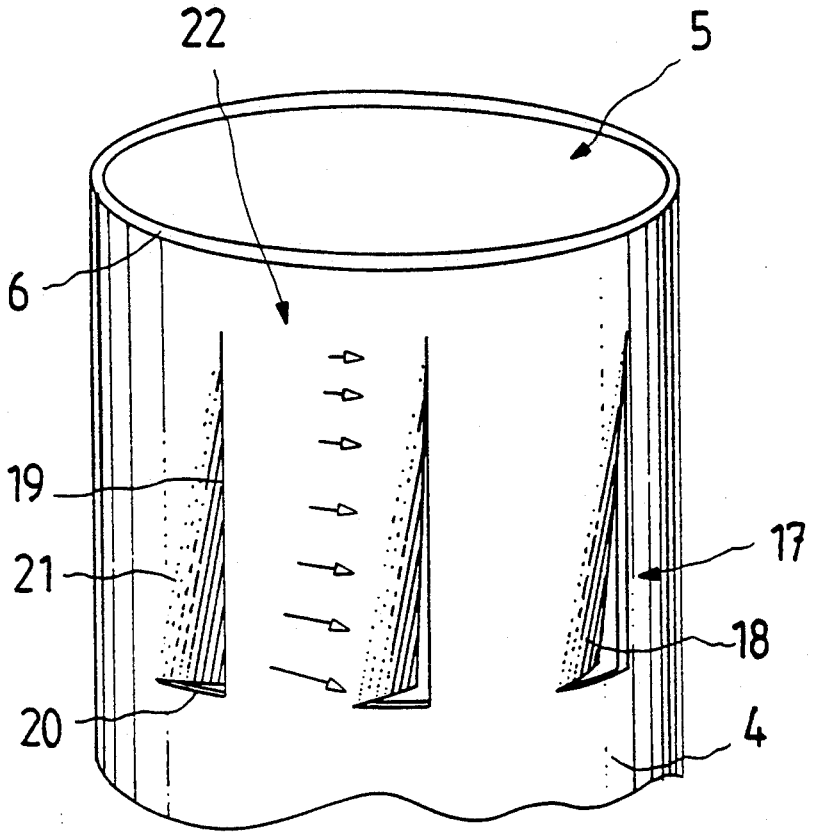
FIG. 5 is a detailed illustration of the apertures of one elongate part of the wall element.
Figure 6:
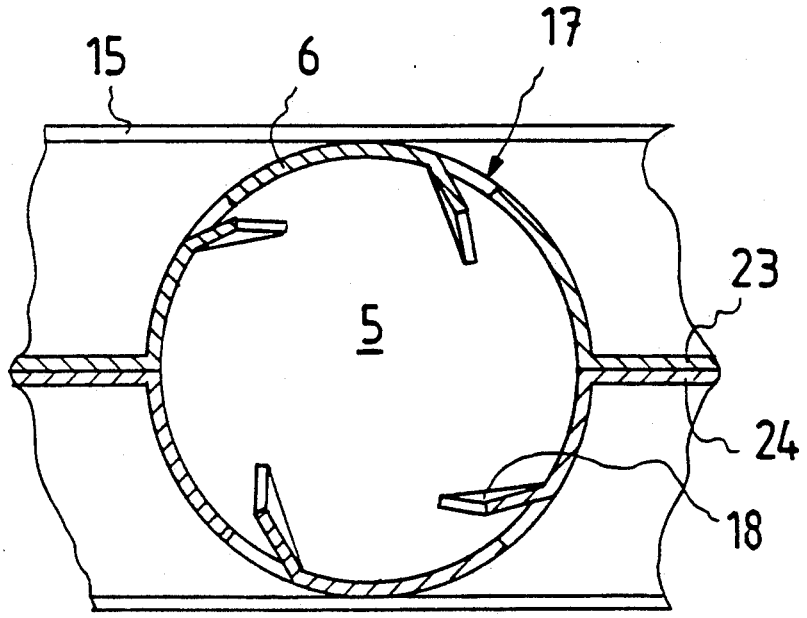
FIG. 6 illustrates the elongate part of FIG. 5, seen in cross-section at the apertures.

The structure and operation of the elongate part 4 of the wall element 3*c* is illustrated in FIGS. 5 and 6. In cross-section, the chamber 5 is a round cylinder, the top part whereof is provided with inlet apertures, i.e. slots 17. In this case they are formed of the shell as follows. A section 19 is made in the shell 16, this section being vertical, i.e. parallel to the axis of the chamber 5, and at the bottom end of this section 19, there is made a perpendicular and shorter transversal section 20. Along the line 21, which connects those ends of the two sections that do not meet, the tongue-shaped part of the shell is slightly bent inside, i.e. into the chamber 5, thus forming a guide 18. In this fashion, the shell is provided with the slot 17, the width whereof grows smoothly from top to bottom, and simultaneously opens downwards in the region of the section 19. The slot 17 is directed essentially tangentially to the inner surface of the shell 6 of the chamber 5.

The elongate part 4 of the wall module 3*c* is operated as follows. When the suction of the ventilation duct network 9 affects the chamber 5 through the outlet aperture 8, there is created an air current in the slot 17, in the direction of the arrows 22. In the top part of the slot 17, there is formed a relatively small and essentially horizontal air current. The volume of the air current grows while proceeding downwards in the slot 17, and at the same time the direction of the current is turned downwards. The largest and most powerful air current takes place in the bottom part of the slot 17, and is directed towards the bottom part of the chamber 5 as a centrifugal circulation rotating against the shell 6 of the chamber. Thus the chamber 5 for the most part functions as a centrifugal air separator, where the exhaust air rises upwards along the central part of the chamber 5. In the top part of the chamber, the main filtering mechanism is based on the effect of impact. Impurities are collected on the inner surface of the chamber 5, and further in the bottom part 15, wherefrom they are removed at suitable intervals.

The wall module is advantageously made of two plates 23 and 24 attached against each other, as is seen in FIGS. 3 and 6. In the plates 23, 34 there are formed, on respective spots, recesses corresponding to the halves of the chamber 5, provided with inlet apertures or slots 17. Thus the wall modules 3*a*, 3*b* and 3*c* can be combine to wall elements with different lengths and shapes, according to the needs in each case, economically and in a simple fashion.

The advantageous measures of a single wall module, and particularly those of the wall module 3*c* of FIG. 4, are as follows. The diameter of the chamber 5 is between 45 . . . 100 mm, and the length thereof between 200 . . . 450 mm. The width of the slots 17 of the chamber 5 is in the bottom end 10 . . . 15 mm, and in the top end 2 . . . 4 mm.

Figure 7:
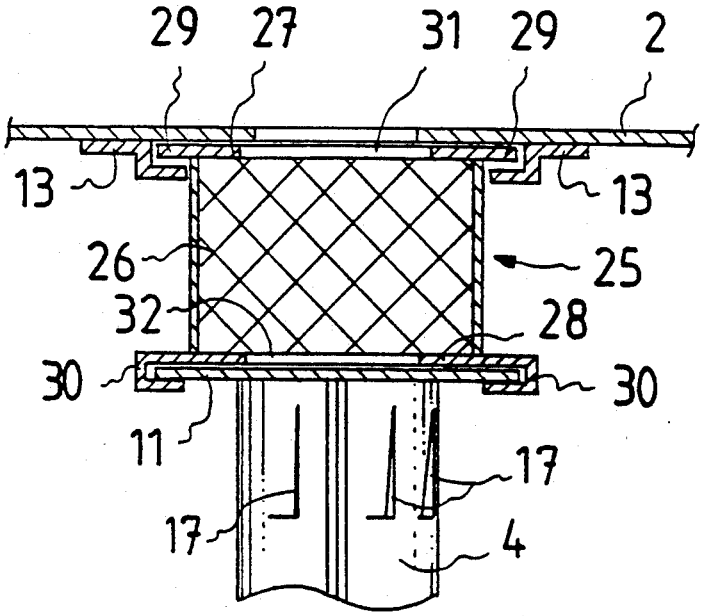
FIG. 7 is an illustration of a ventilation apparatus of the invention, provided with a filter above the wall element.

In between the wall element 3, particularly the wall module 3*a*, 3*b* or 3*c*, and the ceiling 2, there can be arranged an auxiliary filter 25, as is illustrated in FIG. 7. The auxiliary filter 25 is formed as a box essentially having the shape of a right-angled parallelopiped, which box is filled with some suitable filtering material 26, known as such in the prior art. The top and bottom plates 27, 28 of the filter are provided with apertures 31 and 32 respectively, through which apertures the air to be filtered is arranged to flow. The long edges of the top plate 27 of the filter form shoulders 29, whereby the filter can be secured to the fastening rails 13 provided in connection with the ventilation duct network. The long edges of the bottom plate 28 of the filter are provided with fastening rails 30, corresponding to the fastening rails 13, where the wall module 3*a* can respectively be secured by means of the top plate 11.

The top plate 27 of the filter 25 and the top plate 11 of the wall module 3*a* are essentially similar in dimensions; the same applies to the fastening rails 13, provided in connection with the ventilation duct network, and the fastening rails 30 of the filter. Consequently, when necessary, the ventilation duct network 9 can be simply provided with a wall element 3, particularly a suitable wall module 3*a*, 3*c*; or, when extra filtering is desired in between the ventilation duct network 9 and the wall element 3, there can also be installed an auxiliary filter 25 as is illustrated in FIG. 7.

In principle, the ventilation apparatus of the invention is operated as follows. The ventilation apparatus 1 is installed for instance in the ceiling of a kitchen, at a suitable distance from the stove or other such kitchen equipment creating powerful rising air currents. When the vertically rising convection current meets the ceiling, it is spread out towards all directions as a fairly thin layer. When meeting the wall element 3, it is partly sucked into the ventilation duct network 9 through the inlet apertures 7 or slots 17, chambers 5 and outlet apertures 8, and further out of the room. Part of the convection current is turned down at the wall element 3, and if the bottom part of the wall element is provided with a suitable protrusion 16, the current is turned, at least partly, towards its original direction at an oblique angle, and proceeds further as a partial turbulence upwards and is mixed in the air of the room, as is illustrated by arrows in FIG. 2. It is pointed out that owing to the wall element 3, the convection current is not circulated around the room after meeting the ceiling 2, but the wall element 3 limits the circulation of these currents, as well as the odours and particles connected thereto, so that they are not transported around the room.

The wall elements 3, particularly the wall modules 3*a*, 3*b* or 3*c*, can be located in the ceiling 2 of the room as desired. For example, they can be arranged as a square or rectangular ventilation area in that part of the ceiling which is located above kitchen equipment or other corresponding equipment producing vapours etc. On the other hand, the ceiling area can be divided into sections by means of the wall elements 3 as desired. Short wall elements, particularly wall modules 3*a*; 3*b*; 3*c*, can be particularly arranged above the equipment creating convection currents, in the immediate vicinity thereof, in order to ensure sufficient ventilation.

The invention is not limited to the above described preferred embodiments only, but many modifications are possible within the scope of the inventional idea defined in the appended patent claims.

We claim:

1. A ventilation apparatus for attachment to the ceiling of a kitchen, laundry or other location, the ventilation apparatus (1) comprising at least one wall element (3) extending essentially downwardly from the ceiling into a room space and configured to contain fumes in a particular location, the wall element (3) being formed of a plurality of interconnected elongated members (4) defining vertical chambers (5) having inlet aperture (7;17) in fluid communication with the room space and outlets (8) in fluid communication with a ventilation duct network (9), so that exhaust air is conducted through the inlet aperture and out of the room through the outlets (8).

2. The apparatus of claim 1 wherein the inlet apertures (7;17) are arranged on opposite sides (A,B) of the wall element (3).

3. The apparatus of claim 1 wherein the wall element (3) is detachable from the ceiling.

4. The apparatus of claim 1 wherein the wall element (3) is formed of at least one module (3*a*,3*b*,3*c*).

5. The apparatus of claim 1 wherein a filter (25) is interposed between the ceiling and the wall element (3).

6. The apparatus of claim 1 wherein a top plate (11) is attached to the wall element (3) proximate the outlets (8) for engagement with a corresponding fastening rails (13) attached to the ceiling proximate a ventilation duct network (9).

7. The apparatus of claim 6 wherein a filter element (25) is interposed between the ceiling and the wall element (3), the filter element (25) having a top plate proximate an air outlet side of the filter element (25) for engagement with the fastening rails (13) on the ceiling and fastening rails on an air inlet side of the filter element (25) for engagement with the top plate (11) on the wall element (3).

8. The apparatus of claim 7 wherein the elongated members (4) form cylindrical filter chambers (5) having roughly vertical slots (17) proximate the outlets (8), the slots (17) including guides means (18) for setting the incoming exhaust air current into turbulent motion within the chamber (5) so that the air is cleaned by centrifugal force.

9. The apparatus of claim 8 wherein the slots (17) become increasingly wider further away from the outlet (8), the slots being arranged around the chamber (5) at a generally uniform height and at even intervals.

10. The apparatus of claim 8 wherein the guides (18) are constructed by bending a portion of the elongated members (4) inward towards the inside of the chamber (5).

11. The apparatus of claim 9 wherein the length of the slots (17) is less than half the height of the chamber (5).

* * * * *